United States Patent [19]

Spaeth

[11] Patent Number: 5,052,076

[45] Date of Patent: Oct. 1, 1991

[54] SEAT HINGE

[75] Inventor: Kenneth A. Spaeth, Two Rivers, Wis.

[73] Assignee: Estran Corporation, Two Rivers, Wis.

[21] Appl. No.: 506,043

[22] Filed: Apr. 9, 1990

[51] Int. Cl.[5] ..... E05D 7/00

[52] U.S. Cl. ..... 16/266; 16/356

[58] Field of Search ..... 16/266, 356

[56] References Cited

U.S. PATENT DOCUMENTS

| | | | |
|---|---|---|---|
| 230,491 | 7/1880 | Peer . | |
| 770,395 | 9/1904 | Seng | 16/266 |
| 2,677,147 | 5/1954 | Phillips . | |
| 3,131,970 | 5/1964 | McGregor . | |
| 3,245,717 | 4/1966 | Levy . | |
| 3,409,325 | 11/1968 | Hamilton . | |
| 3,936,907 | 2/1976 | Jansons . | |
| 4,058,890 | 11/1977 | Pierce . | |
| 4,334,338 | 6/1982 | Conn | 16/266 |
| 4,383,488 | 5/1983 | Macho . | |
| 4,729,134 | 3/1988 | Hillebrand et al. | 16/266 |
| 4,775,187 | 10/1988 | Herr | 16/257 |

*Primary Examiner*—Robert L. Spruill
*Assistant Examiner*—Carmine Cuda
*Attorney, Agent, or Firm*—Wheeler Law Firm

[57] ABSTRACT

A seat back hinge for a seat on a fishing boat in which the hinge pivot has a generally circular outer pivot wall on one section of the hinge and a generally circular inner pivot wall on the other portion or section of the hinge. The inner wall is of a size that allows it to fit closely inside the outer wall. The inner wall is provided with ears that project at right angles to the top of the inner wall and the outer wall is provided with relieved sections or bays that allow the ears to pass through the outer wall in only one orientation of the two sections of the hinge. Once the seat has been assembled the movement of the two sections of the hinge are limited in such a way so that it is impossible for the ears on the inner wall to be removed back through the relieved sections of the outer wall. Concentric shield portions keep fingers out of the hinge. Integral stops limit movement and an integral leaf spring catches a detent to lock the hinge in one position.

7 Claims, 2 Drawing Sheets

SEAT HINGE

BACKGROUND OF THE INVENTION

The present invention relates to the field of hinges. Specifically the invention relates to seat hinges of the type used for boat seats. Such seats commonly have a back that can fold down over the seat and are usually provided with a strap having a snap at the end to hold the seat in a folded position. That arrangement is useful to keep the seat from getting wet while the boat is not in use during a rain storm.

The hinge that is most commonly used is a pair of metal angles which are fastened together with a large rivet. One angle is bolted to the seat bottom and the other to the seat back so that the rivet serves as a pivot for the hinge. These metal hinges can pinch the fingers of the user if the user puts a hand between the parts of the hinge while the seat is being pushed upright. In addition the provision of the strap on the seat involves assembling a snap to the seat and a snap to the strap as well as sewing the strap to the seat back. An additional assembly operation is involved in riveting the parts of each hinge together. Finally, aluminum has become relatively expensive.

The applicants invention by means of unique and simple design improves greatly upon the common arrangement that is used for seat hinges on both seats. The inventor knows of no prior art which accomplishes what his invention accomplishes.

For example, U.S. Pat. No. 4,775,187 (Herr), discloses a molded plastic seat incorporating a hinge feature. There is a projection 54 on the pin which is part of the seat back which enters a notch 56 to serve as a detent to hold the seat in a folded position. None of the other features of the applicant's invention appear or are present in the Herr invention. Assembly of the Herr invention is taken care of by the use of a resilient material which can change shape enough to permit assembly. U.S. Pat. No. 3,245,717 (Levy), shows a folded seat with hinges molded into the seat and seat back but an additional pin 36 is required for assembly. This is much like the rivet of the metal hinge constructed of metal angles riveted together which is prior art in the industry. U.S. Pat. No. 4,383,488 (Macho), shows a folding stool but the pair of legs at each end are interconnected to form a member similar to the back of a chair. The lock is totally different and depends on the movement of the legs to a different vertical position for locking then unlocking with respect to the pivoting portion. The leg members can be assembled, by snapping them into place, due to the flexibility of the materials. U.S. Pat. No. 3,936,907 (Jansons), covers a molded hinge construction in which plastic hinge leaves are used for a purpose totally different from that of the applicant's invention. In Janson's invention the hinge leaves deflect over the pivot and then snap down capturing the pivot as the hinges are being assembled. The hinge is used to attach parts of a chair together for folding at the joint between the legs and the chair arm. U.S. Pat. No. 3,409,325 (Hamilton), shows a totally different type of molded plastic joint with many separate parts and a lock that consists of a gear and a spline. It is not very close to the structure of the applicant's invention. U.S. Pat. No. 3,131,970 (McGregor), is even less similar in structure to the applicant's invention than was the Hamilton patent since it does not show a hinge at all but merely bolted together chair sections. U.S. Pat. No. 4,334,338 (Conn), shows a tubular molded hinge in which a center section with ears is supported in an outer tube with recesses to allow the ears to pass through for assembly but is otherwise very different from the applicant's invention. In particular it has no stops and no built in latch. U.S. Pat. No. 4,058,890 (Pierce), shows a specialized hinge for assembly of printed circuit boards which can be assembled by moving an ordinary cylindrical pin into a hole and then be locked by rotating the circuit board around the hinge so that a projection on the cylindrical hinge member passes into a non-circular part of the hole while it is being assembled and then rotates to a position where it jams against the circular part of the hole to hold it in place. This is very different from the applicant's stops and latches. U.S. Pat. No. 2,677,147 (Phillips), is likewise a two-piece hinge which can be assembled by moving the cylindrical pin sideways into the bore of the other piece but it otherwise completely lacks the stops and latches found in the applicant's hinge. U.S. Pat. No. 230,491 (Peer), is a two-piece hinge which can be assembled because the pin is on a stem projected from the side while the barrel of the hinge is cut away to allow the pin and the stem to be put in place and then rotated to a position in which they will not separate. No other stops or latches are shown.

SUMMARY OF THE INVENTION

The present invention is a seat hinge of the type for use on boat seats. The object of the invention is to provide a hinge made out of two pieces, each molded from plastic, and requiring no fastening or riveting step whatever for assembly. In addition the strap and snap that are commonly used in prior art boat seats are eliminated because the hinge of this invention is provided with a catch that is an integral part of the two pieces of the hinge. Finally, a hinge guide portion of the flange which surrounds the pivot point of each of the two pieces has a form which is an arc drawn about the pivot point, the two arcs fitting closely with one another and never separating regardless of the orientation of the seat back. For this reason it is not possible to put a hand of a person in a position where it may be pinched. This is best seen in the views which show the hinge assembled (please see attached drawings). The various hinge positions always result in the two flanges overlapping one another without any gap. There are no machining or assembly operations required to construct the two pieces of the hinge after molding.

Looking now at the operation of the hinge, the pivot is provided by a pair of circular walls around a pivot point, one on each piece of the hinge. The outer of the two walls has a pair of rectangular bays or extensions opposite one another. The inner of the two walls has a pair of rectangular ears which can pass through the rectangular extensions of the outer wall when the hinge is being assembled at the factory. Once the two pieces are assembled by sliding the inner pivot wall into the outer pivot wall the hinge is rotated slightly so that the ears of the inner pivot wall are no longer aligned with the rectangular extensions of the opening in the outer pivot wall. The hinge may then be moved to its position in which the respective hinge flanges form the greatest angle with one another. This greatest angle is made by a pair of elevated stop portions on the outer pivot wall which are higher than the rest of the wall so that the ears of the inner pivot wall will strike the elevated portions of the outer pivot wall forming a stop to hold the seat back in the proper fully opened position. While the hinges are in this position the seat is bolted to the co-planar horizontal flanges of the two lower portions of the hinge and the seat back is bolted to the co-planar flanges of the upper portions of the hinge.

Once the seat is in place it is no longer possible to separate the parts of the hinge for several reasons. First, the seat and seat back keep the respective flanges of the hinges at a fixed distance from one another so that the lower portion of the hinge cannot move outward with respect to the rest of the hinge and so that the pivot cannot be disassembled. Second, the upholstery of the cushions of the seat and seat back are compressed when the seat back is lowered, preventing the hinge flanges from moving toward each other enough so that the ears of the inner pivot wall can line up with the rectangular extensions or bays in the outer pivot wall. Therefore, the ears would prevent the portions of the hinge from separating even if the seat and seat back were not keeping those parts at the same distance from one another. In addition, as the seat back approaches the seat, the ears on the inner pivot wall strike the raised stop portions of the outer pivot wall so that the outer pivot wall and the ears form a stop against further seat movement in the closing direction as well as the opening direction.

In the direction of movement for opening the seat, a second pair of stops is provided to limit seat opening in order to provide additional strength to resist pushing the seat back too far. The lower portion of the hinge has an arc shaped flange and the upper portion of the hinge has a second arc shaped flange arranged so that the end of each flange contacts the other when the seat back is in the desired or open position. Since these flanges contact along the entire end of each flange and the base of each flange is integral with the body of the hinge, and the ends of one of the flanges are also connected to the hinge body, this arrangement has considerable strength. The additional strength is needed when the seat back is being raised because when it is being moved in that direction there is no resistance to the movement from the seat upholstery, as there would be when the seat back is being folded back down.

Finally, the catch which holds the seat in its closed or folded down position is comprised of a leaf spring on the lower flange of the hinge which is formed by leaving an opening in the flange bisected by a plastic blade integral with the flange. The blade is at the center of the opening. The end of this plastic spring blade resiliently engages a shoulder on the end of the upper hinge flange when the seat back is folded down to bring the shoulder into engagement with the leaf spring. The leaf spring is provided with an extension projecting outwardly from the hinge flange so that the user can simply depress it with a finger or thumb to release the catch in order to raise the seat.

These features are provided in one hinge comprising only two pieces which require only a simple movement to assemble them, without any forming, sewing, assembling of snaps, setting of rivets or the like. Additionally, the parts of the hinge are formed from materials that are less costly than aluminum. Also the forming operation is a single step whereas the metal seat hinges previously known required several forming operations in addition to the riveting operation before they could be used.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
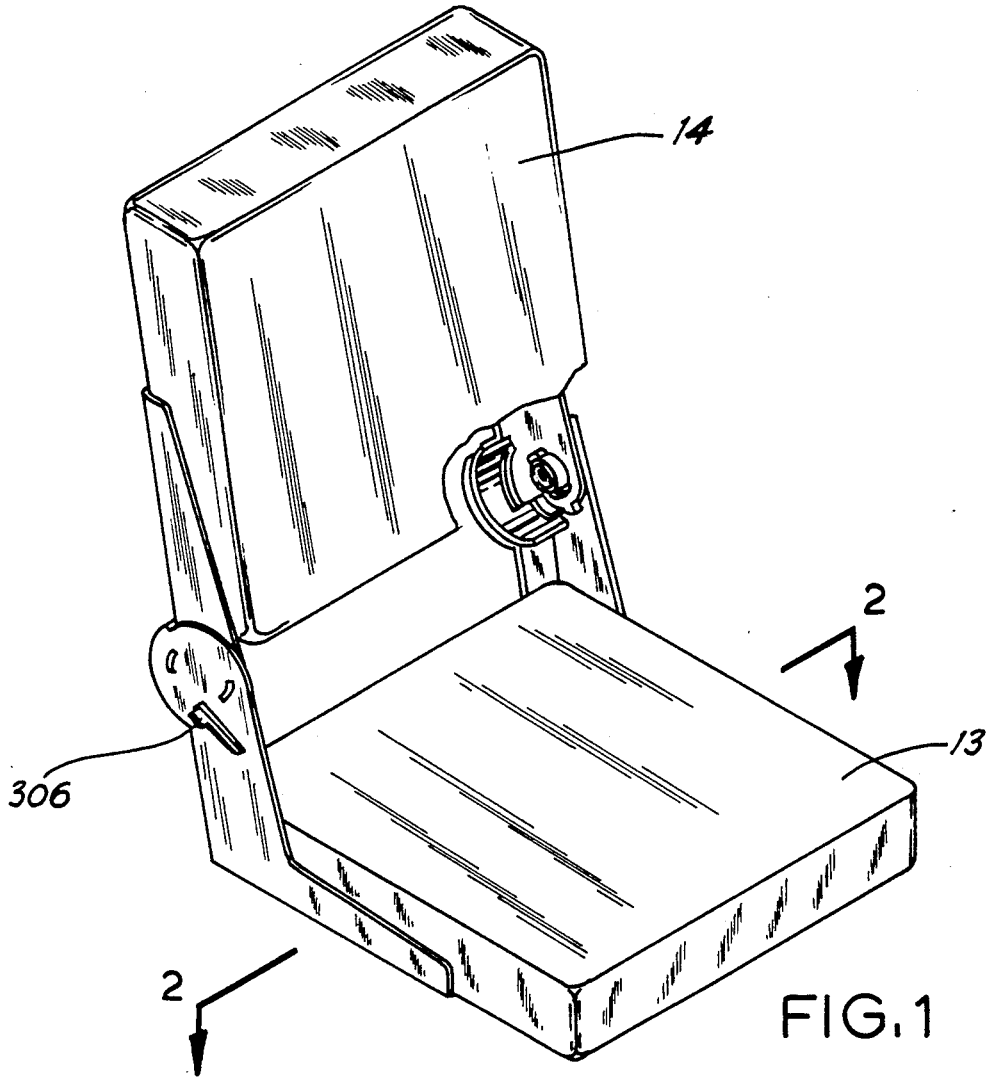
FIG. 1 is a perspective view of the seat hinge attached to a boat seat.
Figure 2:
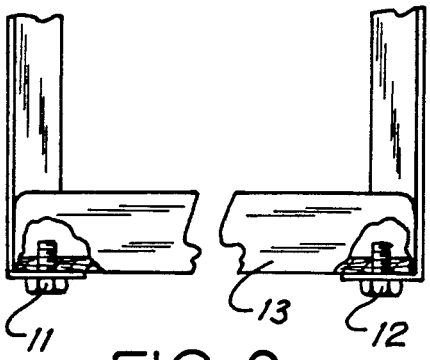
FIG. 2 is a view from line 2—2 of FIG. 1.
Figure 11:
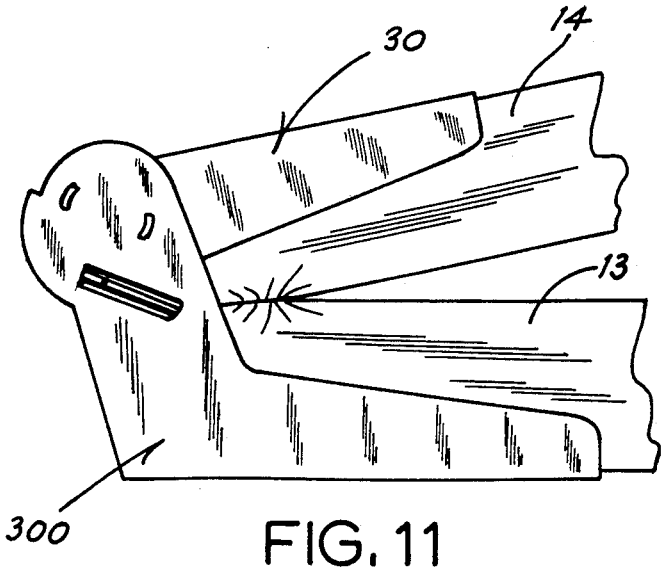
FIG. 11 is a side elevational view of the chair and the hinge.

Referring to FIGS. 1 and 2 the completed hinge 10 may be seen.

FIG. 2 shows the connection made by the bolts 11 and 12 of hinge section 300 with the seat 13. Hinge section 30 is attached in the same manner to seat back 14.

Figure 3:
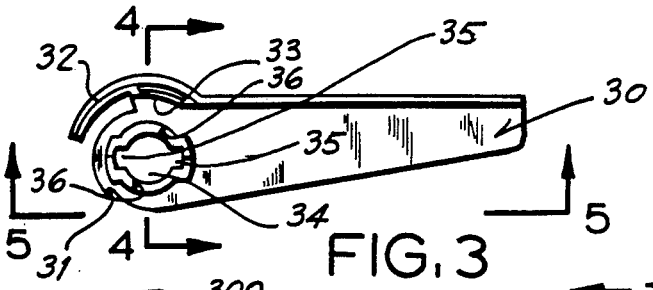
FIG. 3 is a side elevational view showing the outer pivot wall of the seat hinge.
Figure 4:
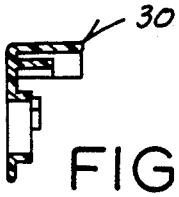
FIG. 4 is a view from line 4—4 of FIG. 3.
Figure 6:
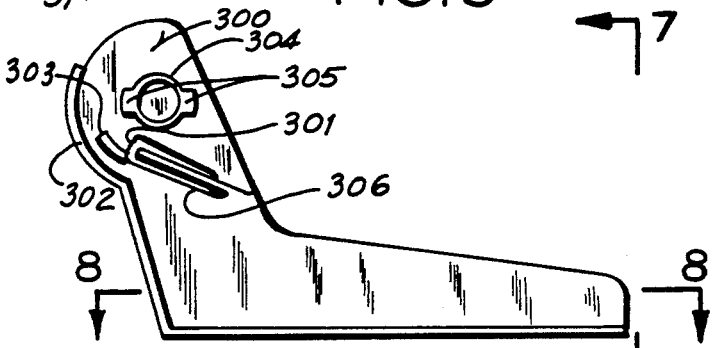
FIG. 6 is an elevational view showing the inner pivot wall of the hinge.
Figure 7:
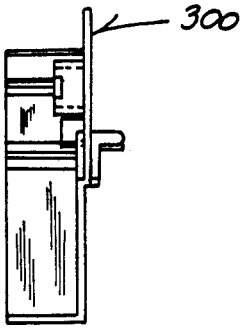
FIG. 7 is a view from line 7—7 of FIG. 6.
Figure 5:
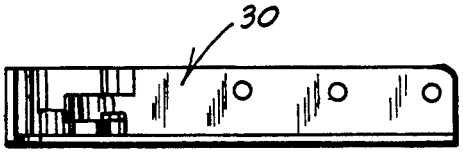
FIG. 5 is a view from line 5—5 of FIG. 3.
Figure 8:
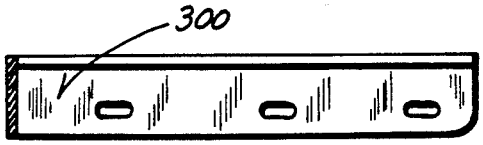
FIG. 8 is a view from line 8—8 of FIG. 6.

Referring to FIGS. 3 and 6 the two separate pieces 30 and 300 which comprise the hinge 10 may be seen.

Referring to FIG. 3 specifically, the outside piece 30 may be seen. The outside piece 30 is comprised of a spring catch stop 31, an arcuate hinge guide 32, an upright stop flange 33, an outer wall hinge pivot socket 34, two elevated stop portions 36, and a pair of rectangular bays 35.

Referring to FIG. 6 the inside piece 300 may be seen to comprise a spring catch 301, an arcuate hinge guide 302, an upright stop flange 303, an inner wall hinge pivot post 304, upright stop extensions 305, and a spring catch lever 306.

The upright stop extensions 305 extend from the inner wall hinge pivot post 304. The rectangular bays 35 are part of the outer wall hinge pivot socket 34. The hinge 10 is formed by placing the inner wall hinge pivot post 304 into the outer wall hinge pivot socket 34. The upright stop extensions 305 of the inner wall hinge pivot post 304 pass into the outer wall hinge pivot socket 34 through the rectangular bays 35. The hinge 10 is then rotated slightly so that the upright stop extensions 305 of the inner wall hinge pivot post 304 are no longer aligned with the rectangular bays 35 of the outer wall hinge pivot socket 34. The hinge 10 may then be moved to its position in which the respective pieces 30 and 300 form the greatest angle with one another. The greatest angle of extension that the two pieces 30 and 300 may reach is determined by the position of the elevated stop portions 36 contained within the outer wall hinge pivot socket 34; please see FIG. 10. The upright stop extensions 305 strike the elevated stop portions 36 causing the seat to stop and hold in the proper fully opened position.

Figure 10:
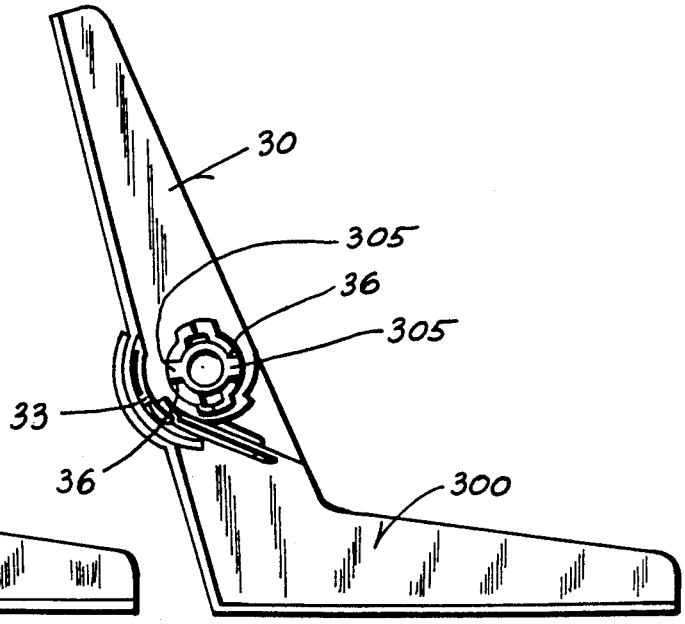
FIG. 10 is a side elevational view showing the relationship of the inner and outer pivot walls when the seat is fully opened.

When the hinge 10 is in the proper fully opened position, as illustrated in FIG. 10, the seat 13 and seatback 14 may be bolted to the two pieces, 30 and 300, of the hinge 10. Once the seat 13 and seatback 14 are bolted in place it is no longer possible to separate the parts 30 and 300 of the hinge 10. This is because the seat 13 and seatback 14 keep the respective parts 30 and 300 of the hinge 10 at a fixed distance from one another so that the upright stop extensions 305 of the inner wall hinge pivot post 304 can no longer pass through the rectangular bays 35 of the outer wall hinge pivot socket 34. Also the bolting of the seatback 14 and seat cushion 13 to the respective pieces 30 and 300 of the hinge on both ends or sides of the folding seat keep the respective pieces fixed in their positions so that they cannot be moved toward or away from each other. This means that even if the upright stop extensions 305 could be moved into position so they could pass through the rectangular bays 35 they could not do so because the outside hinge piece 30 and the inside hinge piece 300 were bolted to the seat 13 and seatback 14 cushions which fix their positions.

Figure 9:
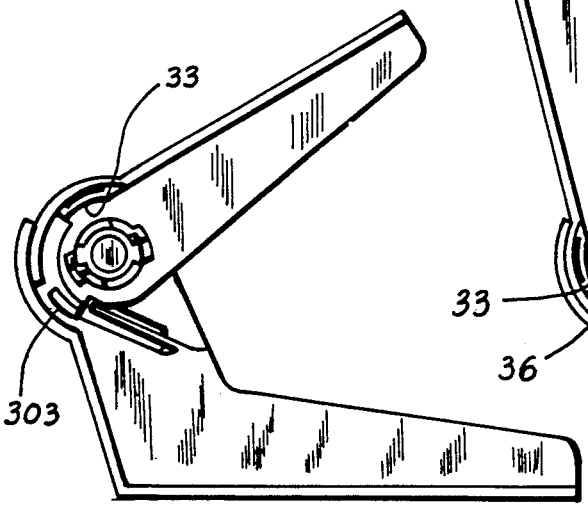
FIG. 9 is a side elevational view showing the relationship of the inner and outer pivot walls when the seat is partially folded closed.

Referring now to FIGS. 9 and 10, a second pair of stops, upright stop flange 33 and upright flange 303, are provided to limit the seat opening so that additional strength is provided to resist pushing the seatback 14 too far. Upright stop flange 33 is arranged so that it will contact upright stop flange 303 when the seat back is pushed to the maximum position. Because these two flanges, 33 and 303 contact along the entire end of each other the base of each flange 33 and 303 is integral with the body of the hinge 10 and the other ends of the flanges 33 and 303 are connected to the body of the hinge 10, giving the hinge 10 considerable strength. This additional strength is needed when the seatback 14 is raised because it is moved in a direction where there is no resistance to movement from the seat upholstery whereas in the other direction there would be resistance from the seat upholstery because the seat would be folded close. Arcuate sections 32 and 302 shield the hinge 10 mechanism and prevent the area of the boat seat from getting his or her fingers caught in the hinge 10.

The above described embodiments of this invention are merely descriptive of its principles and are not to be limiting. The scope of this invention instead shall be determined from the scope of the following claims, including their equivalents.

What is claimed is:

1. A pair of hinges, each hinge comprising:

a first section;

a second section;

said first section having a generally circular outer pivot wall;

said second section having a generally circular inner pivot wall;

said inner pivot wall fitting inside said outer pivot wall to form a pivot having an axis;

said inner pivot wall having key means that project at generally right angles to the top of said inner pivot wall;

said outer pivot wall having key way means;

said key way means allowing said key means to pass through said outer pivot wall in only one orientation of said outer pivot wall to said inner pivot wall;

said first section having a first surface that may be attached to intervening structure;

said second section having a second surface that may be attached to intervening structure;

at least one portion of said first section extending radially away from said first section so that said portion limits the movement of said inner pivot wall in at least one direction;

whereby said hinges are assembled by the interlocking of said outer pivot wall key way means with said inner pivot wall key means and said first and second surfaces of one said hinge are attached to intervening structure on one side of said intervening structure while said first and second surfaces of another said hinge are attached to the other side of said intervening structure thereby making it impossible for said key means to pass through said key way means.

2. The device of claim 1 in which each said section being provided with an arcuate wall portion;

said arcuate wall portion of each said section being concentric with said inner and outer pivot walls;

said arcuate wall portion of said first section fitting closely with said arcuate wall portion of said second section in all orientations of said hinge when said inner pivot wall is in said outer pivot wall.

3. The device of claim 1 in which said hinge is used on foldable seat having a seat back capable of being in an alternatively, upright position and a closed position in which the edge of one said section is provided with a shoulder which is generally radial with respect to said axis of said pivot;

the other said section being provided with a molded integral leaf spring;

said leaf spring being positioned and biased to engage said shoulder only when said seat back is closed.

4. The device of claim 3 in which both said first section and said second section of said hinge are provided with an arcuate flange;

said arcuate flange being at, generally, the same radial distance from axis of said pivot as are said shoulder and said molded integral leaf spring;

said flanges bring so positioned such that the end of each said flange abuts the other when said seat back is in the upright position.

5. A hinge for a foldable seat having a seat back capable of being alternatively in an upright position and a closed position comprising:

a first section;

a second section;

said first section having a generally circular outer pivot wall;

said second section having a generally circular inner pivot wall;

said inner pivot wall fitting inside said outer pivot wall to form a pivot having an axis;

said inner pivot wall having key means that project at generally right angles to the top of said inner pivot wall;

said outer pivot wall having key way means;

said key way means allowing said key means to pass through said outer pivot wall in only one orientation of said outer pivot wall and said inner pivot wall;

said first section having a first surface that may be attached to intervening structure;

said second section having a second surface that may be attached to said intervening structure;

at least one stop portion of said first section extending axially a greater distance than another said portion;

said at least one stop portion limited the movement of said inner pivot wall in at least one direction;

each said section being provided with an arcuate wall portion;

said arcuate wall portion of each said section being concentric with said inner and outer pivot walls;

said arcuate wall portion of said first section fitting closely with said arcuate wall portion of said second section in all orientations of said hinge when said key means is in said key way means;

one said section being provided with a shoulder which is generally radial with respect to the axis of said pivot;

said section not provided with said shoulder being provided with a molded integral leaf spring;

said leaf spring being positioned and biased to engage said shoulder when said seat back is closed;

said first section and said second section of said hinge bring provided with an arcuate flange;

said arcuate flange being at substantially the same radial distance from said axis of said pivot as are said shoulder and said molded integral leaf spring;

each said flange being so positioned such that the end of each said flange abuts the other when said seat back is in the upright position.

6. A hinge comprising;

a first section;

a second section;

said first section having a generally circular outer pivot wall;

said second section having a generally circular inner pivot wall;

said inner pivot wall fitting inside said outer pivot wall to form a pivot;

said inner pivot wall having key means that project at generally right angles to the top of said inner pivot wall;

said outer pivot wall having key way means;

said key way means allowing said key means to pass through said outer pivot wall in only one orientation of said outer pivot wall and said inner pivot wall;

said first section having a surface that may be attached to intervening structure;

said second section having a surface that may be attached to intervening structure;

the edge of one said section being provided with a shoulder which is generally radial with respect to the axis of said pivot;

said section not provided with said shoulder being provided with a molded integral leaf spring;

said leaf spring being positioned and biased to be engagable with said shoulder.

7. A seat hinge comprising;

a first section;

a second section;

a pivot including an inner pivot wall fitting inside an outer pivot wall, connecting said first section and said second section and having a center;

said first section having a wall portion;

and an arcuate wall section;

said arcuate wall section being mounted a fixed distance from said pivot walls;

said arcuate wall section being located adjacent said center and said wall portion of said first section;

said arcuate wall section being generally concentric to said center of said pivot of said hinge and closely fitted to said first section and said second section and means for allowing axial movement of said one section relative to said second section in only one orientation of said sections.

* * * * *